US006003694A

United States Patent [19]

Sharp

[11] Patent Number: 6,003,694

[45] Date of Patent: Dec. 21, 1999

[54] WALL MOUNTED CLOTHES HANGER SUPPORT

[76] Inventor: David G. Sharp, County Rte. 143, P.O. Box 259 B, North Rose, N.Y. 14516

[21] Appl. No.: 08/971,123

[22] Filed: Nov. 20, 1997

Related U.S. Application Data

[63] Continuation of application No. 08/693,850, Aug. 5, 1996, abandoned.

[51] Int. Cl.[6] ..... A47F 5/08

[52] U.S. Cl. ..... 211/87; 211/123

[58] Field of Search ..... 211/87, 70.6, 63, 211/13, 123

[56] References Cited

U.S. PATENT DOCUMENTS

| | | | |
|---|---|---|---|
| 661,557 | 11/1900 | Schwab | 52/27 |
| 2,995,256 | 8/1961 | Schoenfisch | 211/70.6 |
| 3,302,800 | 2/1967 | Zdanowski | 211/123 |
| 3,315,816 | 4/1967 | Mallory | 211/60 |
| 3,380,596 | 4/1968 | Crowl | 211/123 |
| 3,938,667 | 2/1976 | Buckland | 211/87 |
| 4,300,692 | 11/1981 | Moreno | 211/87 |
| 4,336,885 | 6/1982 | Thomas | 211/4 |
| 4,871,074 | 10/1989 | Bryson et al. | 211/13 |
| 5,018,627 | 5/1991 | Moore | 211/123 |
| 5,050,750 | 9/1991 | Mason | 211/123 |
| 5,160,048 | 11/1992 | Leyden et al. | 211/7 |
| 5,265,736 | 11/1993 | Orr | 211/13 |
| 5,316,143 | 5/1994 | Horn | 206/378 |
| 5,647,492 | 7/1997 | Fillios et al. | 211/123 |

FOREIGN PATENT DOCUMENTS

| | | | |
|---|---|---|---|
| 1248063 | 10/1960 | France | 211/87 |

*Primary Examiner*—Ramon O. Ramirez
*Assistant Examiner*—Anita M. King
*Attorney, Agent, or Firm*—George R. McGuire

[57] ABSTRACT

A support for conventional garment hangers is designed for flush mounting against a wall or other vertical surface, thus being particularly effective for space-saving considerations. An inner rectangular member is affixed to the wall surface and has a height less than that of an outer rectangular member. The inner and outer members are connected at their lower edges by a bridge member with opposing surfaces of the inner and outer members in spaced relation. In a first embodiment, a plurality of members having opposite, triangular-shaped surfaces are positioned in side-by-side relation in the space between the inner and outer members. The triangular surfaces are in respective contact with, and preferably fixedly attached to the spaced, opposing surfaces of the inner and outer members. The hanger supporting edge of the outer member is linear in the first embodiment and the hooked ends of supported hangers extend into the spaces between the triangular-shaped members provides spacing and positional stability of the hangers. In a second embodiment, the structural members between the inner and outer members are omitted and the hanger supporting edge of the outer member is scalloped or notched to provide grooves to receive the hooked hanger ends and maintain spacing and positional stability.

7 Claims, 2 Drawing Sheets

WALL MOUNTED CLOTHES HANGER SUPPORT

This application is a continuation of Ser. No. 08/693,850 filed Aug. 5, 1996, now abandoned.

BACKGROUND OF THE INVENTION

The present invention relates to supports for conventional garment hangers, and more specifically to an elongated support for accepting the upper, hooked ends of a plurality of hangers for mounting upon, with its longitudinal axis parallel to a wall or other vertical surface.

The standard, hooked-end garment hanger has been one of the most familiar household items for many years. These hangers are fabricated from bent wire, molded plastic, wood and combinations of such materials. In their most common form, the hangers are essentially planar; that is, the hooked, upper end which engages over a support lies in the same plane as the outwardly extending, garment supporting portions of the hanger.

Supports for both conventional and special-design hangers have been proposed in a multitude of variations including, by way of example, those disclosed in U.S. Pat. Nos. 2,708,522, 3,081,882, 3,120,309, 3,302,800, 3,688,915, 4,548,328, 4,676,382, 4,811,853, 4,953,718, and 5,050,750. The hanger support may be free standing or affixed to some other structure, such as the lower, horizontal surface or an outer edge of a shelf, or vertical, parallel wall surfaces between which the hanger support (e.g., an elongated rod) extends.

In virtually all cases, the support has an axis perpendicular to the planes of hangers suspended thereon. This means that the garment supporting portions of the hangers extend outwardly on each side of the vertical plane passing through the longitudinal axis of the hanger support. Consequently, the hanger support must be spaced from any adjoining vertical surfaces of walls, doors, etc. by a distance equal to at least half the width of the hanger. In other words, elongated hanger supports commonly extend along an axis parallel to and spaced from a vertical wall surface and the suspended hangers and garments carried thereon are generally perpendicular to the wall surfaces.

In locations where space is at a premium, e.g., in mobile homes, recreational vehicles, and other somewhat restricted areas, a significant amount of otherwise free space is taken up by hangers and garments carried thereon perpendicularly to an adjoining, vertical surface. The usual alternative, where it is desired that hangers and garments lie essentially flush against a vertical surface, has been to affix supports in the nature of pegs, hooks, or the like, to such surface. However, supports of that type are generally suitable for accepting only one or two hangers if their space-saving purpose is to be achieved. If support for more than a very few hangers is desired, it is necessary to install a significant number of individual hanger supports, presenting obvious disadvantages in cost, installation time, esthetics, etc.

Accordingly, it is a principal object of the present invention to provide an elongated support adapted to accept several conventional garment hangers which saves a significant amount of free space in the area in which it is installed.

Another object is to provide an attractive, easily installed support for holding a plurality of garment hangers in side-by-side relation.

Another object is to provide a novel and improved garment hanger support which permits the garments to be suspended in an orientation substantially parallel to an adjoining wall surface.

Other objects will in part be obvious and will in part appear hereinafter.

SUMMARY OF THE INVENTION

In accordance with the foregoing objects, the hanger support of the invention, as disclosed in a first embodiment, includes a first, elongated member with a planar rear surface for flush installation against an opposing, vertical wall surface. A second elongated member is affixed to the first with opposing surfaces of the two members spaced from one another by a short distance, e.g., less than one inch. Structural members are positioned at equal intervals between the opposing surfaces of the two elongated members, preferably fixedly attached to both opposing surfaces to enhance structural rigidity and to accept therebetween the free ends of the hooks of conventional garment hangers extending over the upper edge of the second member.

In an alternative embodiment, rather than being linear, the upper, hanger supporting edge of the second elongated member is scalloped or notched to maintain the hangers in a fixed longitudinal position on the support. This configuration may supplement or replace the structural members between opposing surfaces of the first embodiment.

The foregoing, generally summarized features of the hanger support system, as well as others, will be more readily understood and fully appreciated from the following detailed description, taken in conjunction with the accompanying drawings.

DETAILED DESCRIPTION

Figure 1:
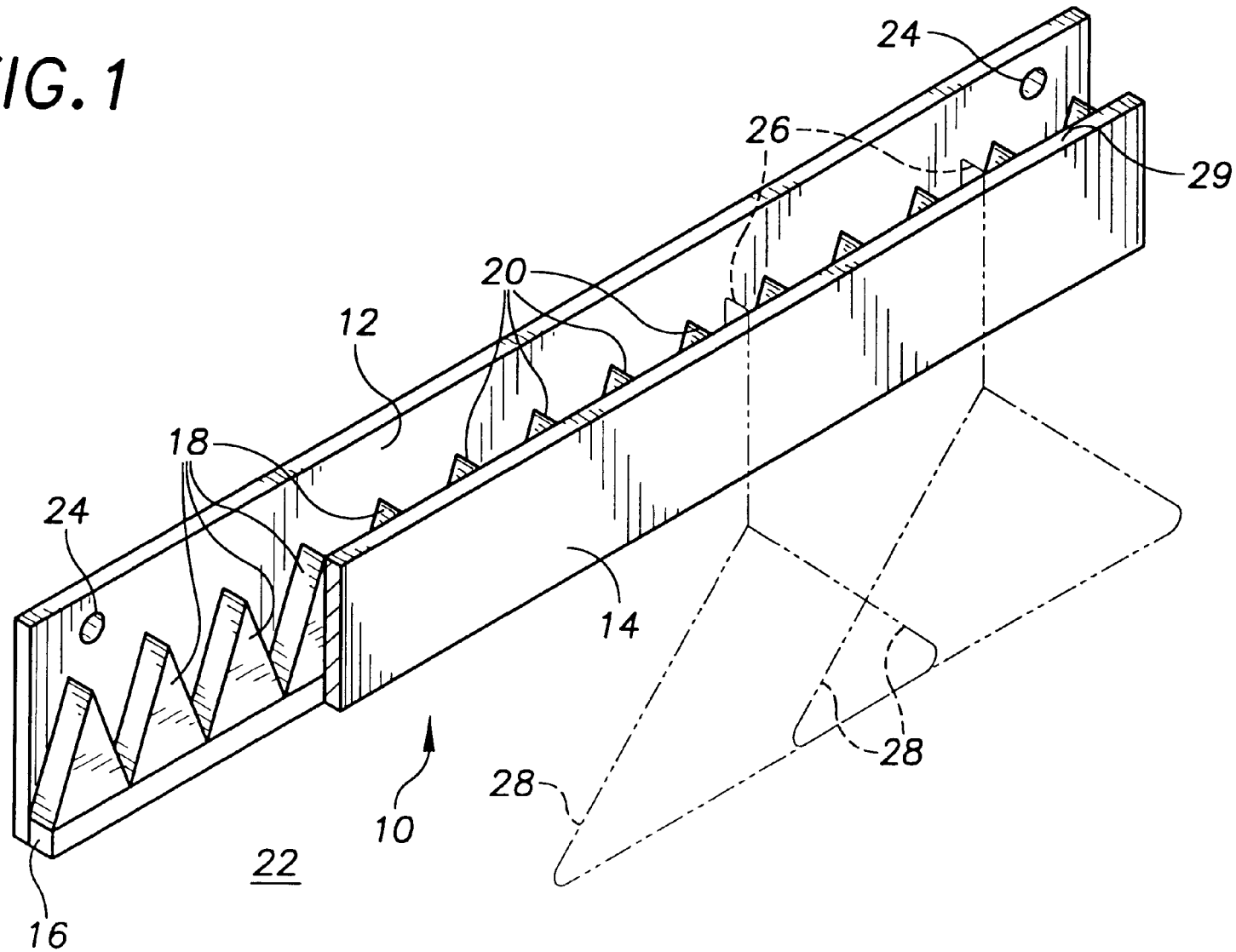
FIG. 1 is a perspective view of a first disclosed embodiment of the hanger support of the invention, with portions broken away, also showing in phantom lines fragments of a wall upon which the hanger support is installed and hangers suspended from the support.

Referring now to the drawings, in FIG. 1 is shown a garment hanger support, denoted generally by reference numeral 10, comprising a pair of elongated members termed inner member 12 and outer member 14. Members 12 and 14, in the form illustrated, are rectangular with planar major surfaces, the length of the members being equal and the height of member 12 being somewhat greater than the height of member 14. Members 12 and 14 are permanently attached to one another along what are considered their lower edges by bridge portion 16 so that opposing surfaces of members 12 and 14 are in spaced, parallel planes. Members 12 and 14 and bridge portion 16 may comprise initially separate pieces which are permanently joined in the indicated configuration, or may be formed as an integral, one-piece, generally U-shaped, metal or plastic extrusion.

Structural members 18 are positioned in the space between the opposing surfaces of members 12 and 14. In the form illustrated, members 18 are triangular in front elevation and have a thickness equal to the distance between the opposing surfaces of members 12 and 14. Preferably, the triangular surfaces of members 18 are permanently affixed, e.g., by glue or other adhesive, to the opposing surfaces of both members 12 and 14, whereby members 18 contribute to the structural rigidity of hanger support 10. Adjacent members 18 are positioned with their bases in mutual contact, whereby the upper edges 20 of members 18 are spaced by distances equal to the width of their bases.

Hanger support 10 is affixed to a vertical surface 22, such as a wall, door, partition, etc. in a location where garments are to be supported on hangers. What is termed the rear surface of support 10 is placed in contact with surface 22 and the support is affixed to the surface by screws 24 or other suitable fastening means with the longitudinal edges of members 12 and 14, i.e., the longitudinal axis of hanger support 10, in a horizontal orientation, parallel to surface 22.

In a typical construction of support 10, members 12 and 14 may have a thickness on the order of ¼", respective heights of about 2¾" and 2" and any desired length. Opposing surfaces of members 12 and 14 are preferably spaced by about ½" to ¾", and upper edges 20 of members 18 are spaced by about 1" to 1¼". As shown in FIG. 1, a plurality of conventional garment hangers, having the usual hooked end portion 26 and outwardly extending, garment supporting portions 28, may be suspended from hanger support 10.

The free end of hooked end portion 26 of each hanger extends into the space between two adjacent members 18, thereby maintaining the hangers in fixed position along edge 30 of member 14. This is particularly advantageous when support 10 is mounted in a vehicle and thus subject to motion which would otherwise cause shifting of the hangers longitudinally of the support.

Figure 2:
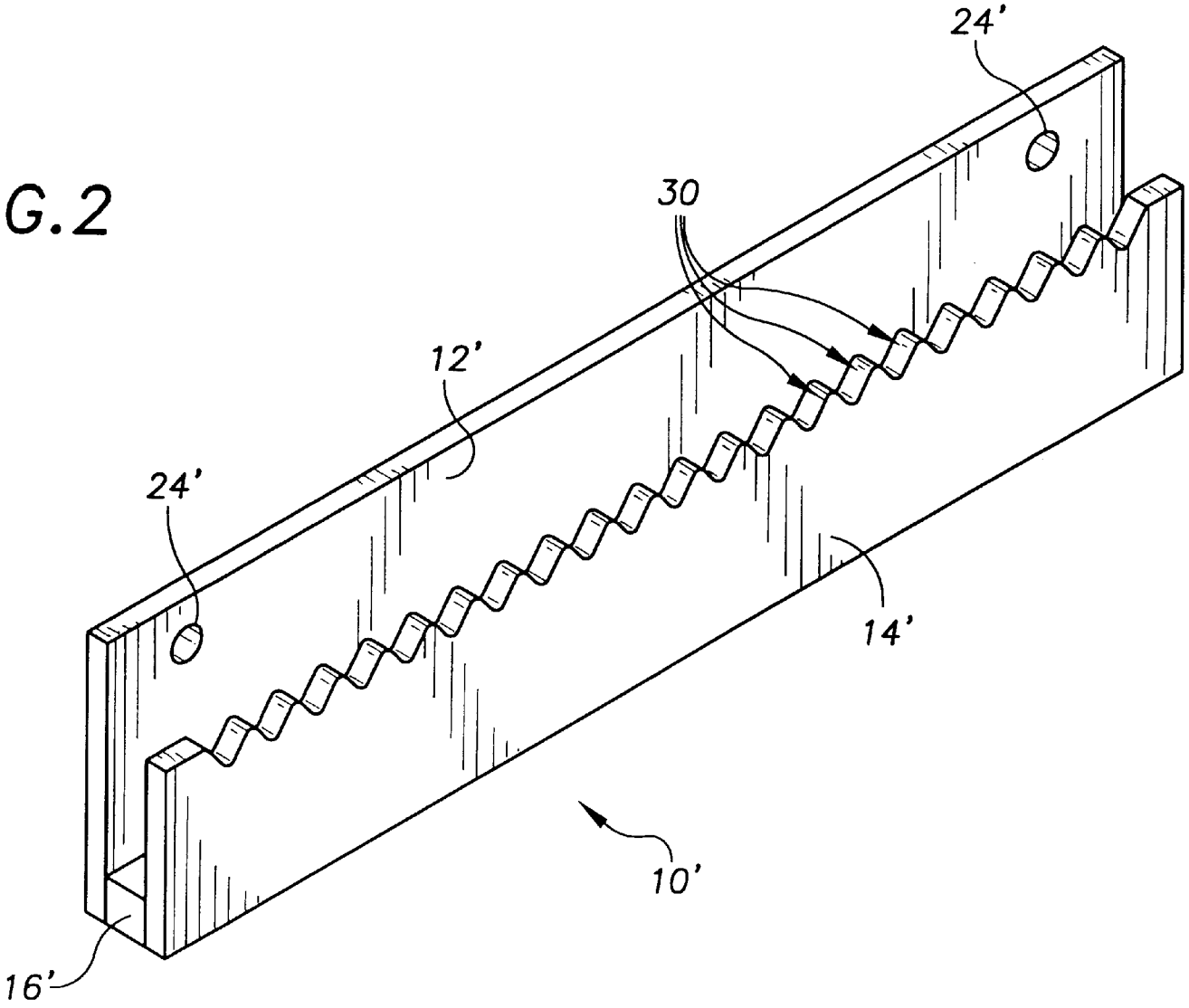
FIG. 2 is a fragmentary, perspective view of an alternate embodiment of the hanger support.

An alternate embodiment of the hanger support, denoted by reference numeral 10', is shown in FIG. 2. Members 12', 14' and 16' are mutually connected in generally U-shaped configuration, as in the first embodiment, and support 10' is mounted flush against a vertical surface by screws 24', extending through openings in member 12'.

It will be noted that the space between opposing surfaces of members 12' and 14' is open, i.e., members 18 of the first embodiment are omitted. Instead, the upper, hanger supporting edge of member 14' is notched or scalloped to provide adjacent, evenly spaced grooves 30. The hooked ends of a plurality of garment hangers may thus be placed over the upper edge of member 14' and will engage in one of grooves 30 to maintain the hangers in a fixed longitudinal position on support 10'.

It will be noted that hooked ends 26 of the hangers shown in FIG. 1 lie in planes perpendicular to the planer of garment supporting portions 28. This may be a more convenient relative orientation of the hooked end to the garment supporting portions when used with the hanger supports of the present invention. The hooked ends of ordinary wire hangers may be easily twisted to this configuration (and twisted back to the original configuration, if desired); other conventional hangers have a hooked end of relatively stiff wire which is freely rotatable with respect to a wooden, garment supporting portion. In any case, the hanger supports are equally effective to support hangers having hooked ends in the same plane as the garment supporting portions.

What is claimed is:

1. A garment support system comprising, in combination:

a) a plurality of garment hangers each having a hooked upper portion with a terminal end and an enlarged lower portion adapted to support a garment placed thereon;

b) a substantially rectangular inner member having elongated upper and lower edges extending continuously llinearly between opposite ends, and planar inner and outer surfaces;

c) a substantially rectangular outer member having elongated upper and lower edges extending continuously linearly between opposite ends, and planar inner and outer surfaces, said inner and outer members having equal lengths along said upper and lower edges between said opposite ends;

d) means for fixedly attaching said inner and outer members to one another with said lower edges in a common plane and said inner member outer surface and said outer member inner surface in spaced, parallel planes to define therebetween a space accessible for downward, unobstructed insertion of said terminal ends into said space and support of said hooked portions upon said linear upper edge of said outer member;

e) means for attaching said inner member to a support surface; and f) means positioned entirely within said space and immovable with respect to said inner and outer members for engaging said terminal ends within said space for preventing longitudinal shifting of said hooked portions along said outer member upper edge.

2. The combination of claim 1 wherein said spacer members each have triangular front and rear surfaces in fixedly attached contact with said outer member inner surface and said inner member outer surface, respectively.

3. The combination of claim 2 wherein said spacer members each have an upper edge perpendicular to said inner member outer surface and substantially in the plane of said outer member upper edge.

4. A garment support system comprising, in combination:

a) a flat support surface in a vertical plane;

b) a plurality of garment hangers each having a hooked upper portion of predetermined dimensions having a terminal end, and an enlarged lower portion adapted to support a garment placed thereon;

c) an inner member having planar inner and outer surfaces;

d) means for immovably attaching said inner member to said support surface with said inner member inner surface contacting and surrounded by said flat surface to prevent passage of said hanger hooked portions over said inner member;

e) an outer member immovably attached to said inner member and having an inner surface facing toward and spa d from said inner member outer surface, said terminal ends being positioned between said inner member outer surface and said outer member inner surface; and f) means for preventing longitudinal shifting of said hangers along said upper edge of said outer member, said means for preventing being mounted entirely between said inner member outer surface and said outer member inner surface, physically contacted by said terminal ends and entirely immovable with respect to said inner and outer members.

5. The combination of claim 4 wherein said means for preventing shifting comprise a plurality of spacer members positioned between said inner member outer surface and said outer member inner surface and immovably fixed with respect thereto.

6. The combination of claim 5 wherein said spacer members each have a linear edge perpendicular to said outer member upper edge and a pair of side surfaces extending downwardly and outwardly from said linear edge.

7. The combination of claim 6 wherein said spacer members each have triangular shaped front and rear surfaces respectively contacting and affixed to said outer member inner surface and said inner member outer surface.

* * * * *